US010844552B2

(12) United States Patent
van Raam et al.

(10) Patent No.: US 10,844,552 B2
(45) **Date of Patent: *Nov. 24, 2020**

(54) SPORTS FIELD STRUCTURE AND METHOD FOR FORMING THE SAME

(71) Applicant: Permavoid Limited, Leicester (GB)

(72) Inventors: Carolus Hermanus van Raam, Hoogmade (NL); Andrew Bryan Shuttleworth, Poulton-le Fylde (GB); Paul David Culleton, Warrington (GB)

(73) Assignee: PERMAVOID LIMITED, Leicester (GB)

( * ) Notice: Subject to any disclaimer, the term of this patent is extended or adjusted under 35 U.S.C. 154(b) by 0 days.

This patent is subject to a terminal disclaimer.

(21) Appl. No.: 16/279,812

(22) Filed: Feb. 19, 2019

(65) Prior Publication Data

US 2019/0284769 A1 Sep. 19, 2019

Related U.S. Application Data

(60) Division of application No. 15/124,786, filed as application No. PCT/EP2015/055032 on Mar. 11, (Continued)

(30) Foreign Application Priority Data

Mar. 12, 2014 (NL) ..... 2012414

(51) Int. Cl.
*E01C 13/02* (2006.01)
*E01C 3/00* (2006.01)
*E01C 13/08* (2006.01)

(52) U.S. Cl.
CPC ..... *E01C 13/02* (2013.01); *E01C 3/006* (2013.01); *E01C 13/08* (2013.01); *E01C 2201/20* (2013.01)

(58) Field of Classification Search
CPC ..... E01C 13/02; E01C 3/006; E01C 13/08; E01C 2201/20
(Continued)

(56) References Cited

U.S. PATENT DOCUMENTS 2,460,894 A 2/1949 Martinovich
2,874,844 A 2/1959 Wanner
(Continued)

FOREIGN PATENT DOCUMENTS

CA 2409637 A1 4/2004
CN 1337494 A 2/2002
(Continued)

OTHER PUBLICATIONS

DE 202011106604 U1 NL 1018903, English language International Search Report from PCT/NL2012/050629, dated Aug. 2, 2013, which is provided herewith.
(Continued)

*Primary Examiner* — Michael D Dennis
(74) *Attorney, Agent, or Firm* — Adsero IP

(57) ABSTRACT

A sports field comprises a base structure and a cover. The cover is at least partly permeable to fluid, especially water. The base structure comprises voids for containing fluid. The base structure forms a substantially continuous deck supporting the cover. The cover comprises or is formed by an artificial sports layer, such as artificial grass. At least a number of the voids are in fluid communication with each other. Wick elements are provided fluidly connecting at least a number of the voids with the cover for supplying fluid from the voids to the top layer.

7 Claims, 8 Drawing Sheets

Related U.S. Application Data

2015, now Pat. No. 10,208,434, which is a continuation of application No. 14/207,139, filed on Mar. 12, 2014, now Pat. No. 9,631,328.

(58) Field of Classification Search
USPC ..... 472/92
See application file for complete search history.

(56) References Cited

U.S. PATENT DOCUMENTS

| | | | | |
|---|---|---|---|---|
| 3,215,118 | A | 11/1965 | Behlen | |
| 3,611,997 | A | 10/1971 | Benno | |
| 3,848,568 | A | 11/1974 | Hazen | |
| 4,176,622 | A | 12/1979 | Wolf | |
| 4,280,447 | A | 7/1981 | Laurenz | |
| 4,364,331 | A | 12/1982 | Foenard | |
| 5,218,783 | A | 6/1993 | Langezaal | |
| 5,373,661 | A | 12/1994 | Furukawa | |
| 5,437,698 | A | 8/1995 | Furukawa | |
| 5,724,916 | A | 3/1998 | Brodie | |
| 5,967,092 | A | 10/1999 | Pederson | |
| 6,237,285 | B1 | 5/2001 | Yoshida | |
| 6,499,433 | B2 | 12/2002 | Notenbomer | |
| 6,511,257 | B1 | 1/2003 | Seaux | |
| 6,606,823 | B1 | 8/2003 | McDonough | |
| 6,694,672 | B1 | 2/2004 | Hergeth | |
| 6,732,666 | B2 | 5/2004 | Layt | |
| 6,779,946 | B1 | 8/2004 | Urriola | |
| 6,898,909 | B2 | 5/2005 | Prat | |
| 7,014,390 | B1 | 3/2006 | Morris | |
| 7,596,906 | B2 | 10/2009 | Gold | |
| 7,603,808 | B2 | 10/2009 | Carpenter | |
| 7,676,987 | B2 | 3/2010 | Yoshida | |
| 7,704,011 | B2 | 4/2010 | Marshall | |
| 7,716,873 | B2 | 5/2010 | Irwin | |
| 7,827,938 | B2 | 11/2010 | Kuehlmann | |
| 7,914,228 | B2 | 3/2011 | Rapaz | |
| 8,128,312 | B2 | 3/2012 | Stuchell | |
| 8,209,905 | B2 | 7/2012 | Furumura | |
| 8,272,163 | B2 | 9/2012 | Dubner | |
| 8,414,217 | B2 | 4/2013 | Rosan | |
| 8,464,490 | B2 | 6/2013 | Rapaz | |
| 8,479,443 | B2 | 7/2013 | Buist | |
| 8,555,586 | B2 | 10/2013 | Lowe | |
| 8,657,695 | B2 | 2/2014 | Wilson | |
| 8,790,037 | B2 | 6/2014 | Culleton | |
| 9,015,992 | B1 | 4/2015 | Livingston | |
| 9,167,743 | B2 | 10/2015 | Li | |
| 9,265,200 | B2 | 2/2016 | Buist | |
| 9,631,328 | B2 | 4/2017 | van Raam | |
| 10,208,434 | B2 | 2/2019 | van Raam | |
| 2003/0186025 | A1 | 10/2003 | Rapaz | |
| 2003/0188505 | A1 | 10/2003 | Marshall | |
| 2005/0042394 | A1 | 2/2005 | Sawyer | |
| 2005/0044791 | A1* | 3/2005 | Morandini | A01G 9/00 47/65.9 |
| 2005/0047866 | A1* | 3/2005 | Chen | E01C 7/14 404/75 |
| 2005/0076855 | A1 | 4/2005 | Throndsen | |
| 2006/0045994 | A1* | 3/2006 | Dipple | E01C 13/08 428/17 |
| 2006/0081159 | A1 | 4/2006 | Chapman | |
| 2006/0124074 | A1 | 6/2006 | Koelker | |
| 2007/0157514 | A1 | 7/2007 | Carpenter | |
| 2008/0149188 | A1 | 6/2008 | Zimmerman | |
| 2008/0236041 | A1 | 10/2008 | Carpenter | |
| 2009/0260284 | A1 | 10/2009 | Barbalho | |
| 2010/0064580 | A1 | 3/2010 | Irwin | |
| 2012/0040767 | A1* | 2/2012 | Wilson | E01C 3/006 472/92 |
| 2012/0163911 | A1 | 6/2012 | Culleton | |
| 2012/0178542 | A1 | 7/2012 | Culleton | |
| 2012/0291714 | A1 | 11/2012 | Stal | |
| 2012/0321389 | A1 | 12/2012 | Kreikemeier | |
| 2013/0284397 | A1 | 10/2013 | Storm | |
| 2014/0026480 | A1 | 1/2014 | Lenhart | |
| 2014/0059926 | A1 | 3/2014 | Li | |
| 2014/0270945 | A1 | 9/2014 | Bach | |
| 2014/0286704 | A1 | 9/2014 | Bennett | |
| 2015/0181813 | A1 | 7/2015 | Van Raam | |
| 2015/0282438 | A1 | 10/2015 | Van Raam | |
| 2015/0334980 | A1 | 11/2015 | Van Raam | |
| 2017/0030026 | A1 | 2/2017 | Van Raam | |

FOREIGN PATENT DOCUMENTS

| | | | |
|---|---|---|---|
| CN | 101084733 | | 12/2007 |
| CN | 101111650 | | 1/2008 |
| CN | 100436723 | C | 11/2008 |
| CN | 101323510 | | 12/2008 |
| CN | 101608491 | A | 12/2009 |
| CN | 201460055 | U | 5/2010 |
| CN | 201541554 | U | 8/2010 |
| CN | 201919461 | | 8/2011 |
| CN | 202077460 | U | 12/2011 |
| CN | 102747665 | A | 10/2012 |
| CZ | 22468 | | 7/2011 |
| DE | 9207171 | U1 | 7/1992 |
| DE | 29610425 | U1 | 11/1996 |
| DE | 19911409 | A1 | 9/2000 |
| DE | 202011106604 | U1 | 11/2011 |
| EP | 266701 | A2 | 5/1988 |
| FR | 2671121 | A1 | 7/1992 |
| JP | 06209655 | | 8/1994 |
| JP | 200245043 | | 2/2002 |
| KR | 20110112524 | A | 10/2011 |
| NL | 1018903 | | 3/2003 |
| WO | WO 2002/014608 | | 2/2002 |
| WO | WO 2009/030896 | | 3/2009 |
| WO | WO 2011/007128 | | 1/2011 |
| WO | WO 2012/050529 | | 4/2012 |
| WO | WO 2014/006180 | | 1/2014 |

OTHER PUBLICATIONS

CZ 22468 DE 9207171 U1 DE 19911409 A1 DE 29610425 U1 FR 2671121 A1 JP 06209655 JP 200245043, English language International Search Report and Written Opinion from PCT/EP2013/064245, dated Oct. 9, 2013, which is provided herewith.

CN 101084733 CN 101608491A CN 201460055U EP 0266701A2, Office Action and Search Report from CN 201380043173.5 dated Jan. 12, 2016 with English Translation, which is provided herewith.

CN 101111650 CN 101323510 CN 201541554U CN 201919461 CN 202077460U, Office Action from CN Application No. 201280075713.3 dated Mar. 28, 2016, with English Translation, which is provided herewith.

CN 100436723C, English language abstract and the Office Action from CN Application No. 201380043173.5 dated Dec. 20, 2016 both submitted herewith.

CA 2409637A1, English language abstract submitted herewith.

CN 1337494A, English language machine translation submitted herewith.

CN 102747665A, English language abstract submitted herewith.

KR 20110112524A, Office Action from CN 201580024763.2, dated Apr. 4, 2018 with English translation, submitted herewith.

Office Action from CN Application No. 201580024763.2, English machine translation, submitted herewith.

International Search Report & Written Opinion from PCT/EP2013/064245 dated Oct. 9, 2013.

International Search Report from PCT/NL2012/050629 dated Aug. 2, 2013.

International Search Report from PCT/EP2015/055032 dated May 7, 2015.

Notice of Allowance from U.S. Appl. No. 14/207,139 dated Oct. 24, 2016.

Notice of Allowance from U.S. Appl. No. 14/207,139 dated Jan. 10, 2017.

Notice of Allowance from U.S. Appl. No. 15/124,786 dated Oct. 31, 2018.

(56) References Cited

OTHER PUBLICATIONS

Office Action from CN Application No. 201280075713.3 dated Mar. 28, 2016.
Office Action and Search Report from CN Application No. 201380043173.5 dated Jan. 12, 2016.
Office Action from CN Application No. 201380043173.5 dated Dec. 20, 2016.
Office Action from CN Application No. 201580024763.2 dated Apr. 4, 2018 with English Translation.
Office Action from U.S. Appl. No. 14/207,139 dated Jun. 17, 2015.
Office Action from U.S. Appl. No. 14/207,139 dated Apr. 6, 2016.
Office Action from U.S. Appl. No. 14/424,285 dated Apr. 14, 2016.
Office Action from U.S. Appl. No. 14/412,324 dated Aug. 12, 2016.
Office Action from U.S. Appl. No. 15/124,786 dated Mar. 29, 2017.
Office Action from U.S. Appl. No. 14/412,481 dated May 25, 2017.
Office Action from U.S. Appl. No. 15/124,786 dated Nov. 28, 2017.

* cited by examiner

SPORTS FIELD STRUCTURE AND METHOD FOR FORMING THE SAME

RELATED APPLICATIONS

This application is a Division of U.S. application Ser. No. 15/124,786, filed Sep. 9, 2016, which is a 35 U.S.C. § 371 national phase application of PCT/EP2015/055032 (WO 2015/135972), filed on Mar. 11, 2015, each entitled "Sports Field Structure and Method for Forming the Same", which application claims priority from Netherlands Application No. 2012414, filed Mar. 12, 2014 and which is a Continuation of U.S. application Ser. No. 14/207,139, filed Mar. 12, 2014, each of which is incorporated herein by reference in its entirety.

The invention relates to a sports field structure. Furthermore the invention relates to a method for forming a sports field.

Sports such as for example but not limited to football, soccer and rugby, hockey, athletics, equestrian and others have traditionally been played on pitches covered by grass. These are costly to maintain since they are maintenance prone. They are moreover very susceptible to climate. For example they may become saturated with water or dry out due to sun shine and heat. Moreover, such pitches will easily be damaged.

In order to avoid these problems and allow a more intensive use of sports fields artificial sports fields have been developed, for example made of plastic material. They may be woven and/or non woven and can comprise for example artificial grass filaments, representing haulms. A filling material such as sand or rubber filler elements can be provided in between such filaments.

Traditionally such sports fields comprise a base, on which drainage pipes are positioned. Then a draining sand layer is provided over said pipes and a layer of lava stone over said layer of sand. On said lava layer an elastic base layer of rubber or the like can be provided, over which a layer of gee textile is placed, protecting the top layer. Then the top layer is provided, comprising a layer of artificial grass. This top layer may be glued or otherwise adhered to the geo textile. Then a layer of sand or rubber filler elements may be provided on top of the artificial grass, for providing further stability.

Artificial sports fields are generally more durable and require less maintenance. A disadvantage of such artificial sports fields may be that they may heat up and get over heated. Such over heating may be detrimental to the top layer but also to the players and other people on the field. A heated top layer may negatively influence the players and may lead to scorching when for example a player falls or makes a sliding or the like movement on the field. In order to avoid such overheating these sports fields have to be sprayed with water regularly, sometimes even at intervals during and between games played on said field, in order to prevent overheating of the sports field, especially the top layer. To this end the sports field has to be provided with a spraying installation with sprayers retractable into the field. Such installation is costly and prone to regular maintenance. Moreover the sprayers may influence the levelness of the sports field, at least locally, and may also make the surface slippery whilst wet. Moreover the spraying installation can only be used when the field is not in use.

An aim of the present disclosure is to provide for an alternative sports field structure. An aim of the present disclosure is to provide for a sports field structure in which the temperature of at least the surface can be controlled and/or regulated. An aim of the present disclosure is to provide for a sports field which is relatively easy to form and maintain. An aim of the present disclosure is to provide for a sports field which can be temperature regulated even during use. An aim of the present disclosure is to provide for a method for forming a sports field.

At least one of these and other aims is obtainable with a sports field structure and modules therefore according to this disclosure.

In an aspect this disclosure can be characterised by a sports field, comprising a base structure and a top layer, wherein the top layer is at least partly permeable to fluid, especially water, wherein the base structure comprises voids for containing fluid. The base structure forms a substantially continuous deck supporting the top layer, wherein the top layer comprises, is formed by or covered by an artificial sports layer, such as artificial grass. At least a number of said voids may be in fluid communication with each other. Wick elements are provided fluidly connecting at least a number of said voids with said top layer for supplying fluid from said voids to said top layer Through the wick elements fluid, especially water can be supplied to the top layer through the wick elements. The fluid can then regulate the temperature and humidity of the top layer and/or a cover layer provided thereby or there over, for example by evaporation. The fluid in the voids can for example be water such as rain water drained through the top layer, but it can also be fluid, especially water supplied in a different manner, for example from a storage tank or a mains. For example by regulating the amount of fluid in the void or voids and the number and type of wick elements the supply of fluid to the top layer can be controlled and/or regulated.

In an aspect the disclosure can be characterized in that the base structure comprises a series of base elements, interconnected for forming the base structure defining the deck, wherein the base elements preferably comprise a deck and an bottom, interconnected by at least an array of pillars, wherein preferably at least the deck is provided with openings for passing said fluids. The or each wick element can be provided at or in a column and can for example fill the column entirely or in part.

A base element can be a generally box shaped element, having at least a bottom and said deck, spaced apart and connected to each other by the pillars. The base element may have side walls and preferably encloses an internal volume, in communication with the wick element, which may be formed by of comprise a suitable wick medium in said pillars. The internal volume can be designed for containing a volume of water that can be transported from the internal volume of the base element to the top layer through the wick element or elements, such as for example through the pillars. Base elements can be interconnected forming a base structure. Interconnected base elements preferably each have an internal volume, the internal volumes being in fluid connection, effectively forming a joined internal volume. The deck of a base element can be substantially flat, such that interconnected base elements can provide for a substantially flat continuous surface area, which can be partly or entirely covered by the top layer. A membrane can be provided between the top layer and the deck.

A membrane can be placed over the deck or joined decks, and can be connected to the or each deck by locking elements locking the membrane into the pillar or opening in the deck opening into the pillar. To this end the membrane, especially an edge portion of a slit or cut-out can be pushed into the pillar or opening in the deck opening into the pillar and be held in place by a locking element forced into said opening or open top of the pillar. The locking element can for example fit in said opening or pillar end by a form lock, a snap lock, threading or any other suitable means. Alternatively the top layer can be placed directly on the deck and can then, if desired, be locked in placed as described here above. Alternatively it can be placed freely on top of the deck or can otherwise be connected to the deck, for example by glue or adhesive or tape.

A base element of this disclosure can for example be made of plastic and can have a deck which is resiliently flexible for providing added flexibility to an area made using such base elements.

In embodiments at least one membrane or layer, or, if two or more such membranes are provided, at least one of the membranes or layers provided on top of the modules, supporting the top layer directly or indirectly, for example by means of a sub layer, can be fluid tight, especially substantially water impermeable, such that water cannot pass through said membrane into or out of the module, unless specific provisions are provided in said membrane, such as openings, valves, water permeable elements, such as filters or drainpipes or the like, opening into or out of the said modules. In embodiments at least one membrane on top of the modules can be fluid permeable, especially water permeable, such that fluid, especially water can pass through the membrane into and/or out of the module.

In further elucidation of the present invention embodiments of the present disclosure, such as embodiments of a plant surface structure and plant areas formed therewith, as well as methods for forming the same shall be described hereafter, with reference to the drawings. In the description a base element for a plant surface structure of this disclosure will also be referred to as module.

FIG. 1 shows in cross section schematically part of a sports field structure, comprising a base element with a deck and pillars, membrane and top layer;

FIG. 1A a connection between a pillar and a wick element or wick material inside such pillar and a cover in a structure according to the disclosure;

Figure 1:
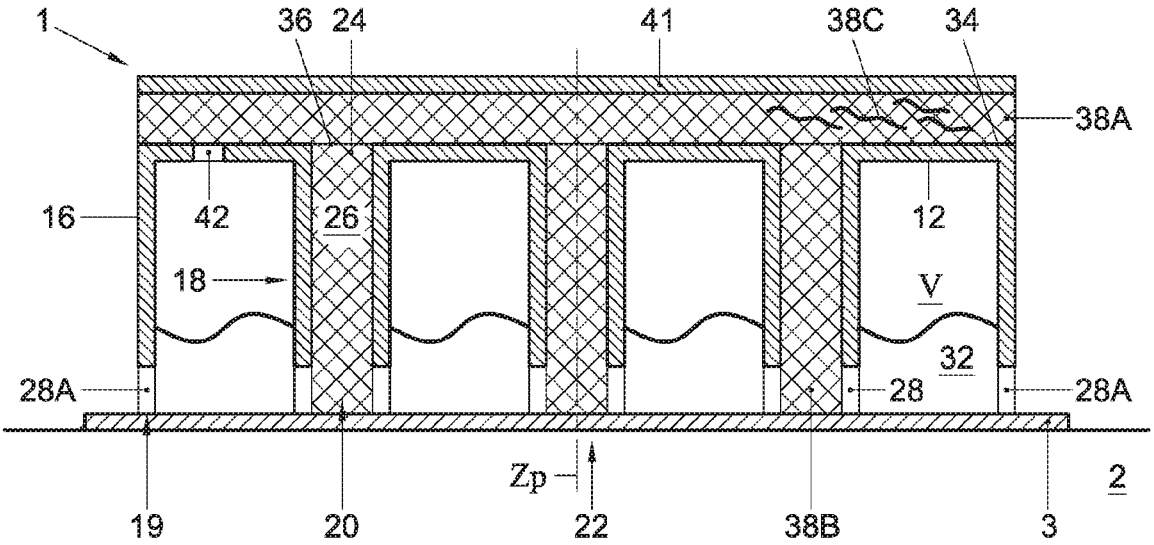

In this description embodiments of the invention will be described with reference to the drawings by way of example only. These embodiments should by no means be understood as limiting the scope of the disclosure. At least all combinations of elements and features of the embodiments shown are also considered to have been disclosed herein. In this description the same or similar elements and features will be referred to by the same or similar reference signs.

In this description expressions of orientation such as top, bottom, vertical etcetera are used for convenience only and refer to the orientation of the module as seen in the accompanying drawings. Such expressions are not to be regarded as limiting the orientation of the module in use, and indeed, as will be described below, modules according to the description can be used in other orientations, including at, least at sloping surfaces.

In this description a cover should be understood as meaning at least a layer or a set of layers of one or more materials, providing a surface for forming a sports field. Such cover may comprise or be formed by a cover layer. Such cover may comprise a top layer providing for such surface or may comprise a top layer and a cover layer on such top layer. Moreover such cover may comprise a layer or membrane on a substructure. A surface of the cover can form a surface for performing sports on.

In this description a cover layer or a surface of the cover has to be understood as at least meaning any material or mixture or combination of materials and/or elements or structures, partly or entirely artificial, suitable as a surface for sports, such as but not limited to artificial grass or turf. Such cover layer or surface can be woven or non woven and can comprise one or more integrated and/or separate layers. A cover layer or surface can be formed by any suitable such sports field top layer such as for example Astroturf, GrienfFields marketed by Ten Cate, The Netherlands, Desso, KSP, XtreineTurf, marketed by ACT Global Sports, and similar layers and materials, or a type of layer suitable for athletics, such as Regupol, marketed by BSW, Germany, preferably fulfilling the requirements of for example DIN 18035-6. A top layer is preferably relatively flexible and may be placed from a roll or in sheets. A cover layer can be integral with a top layer as to be described or can be a separate layer.

In this description a wick element or wick medium is to be understood as at least including any material or element suitable for transporting fluid, especially water from a void below the top layer to the top layer, preferably by at least capillary action. The transport may preferably be achieved passively, i.e. without the necessity of a pump or such mechanically means for transporting the fluid from said void to the top layer. Suitable wick mediums can for example be but are not limited to soil, mixtures of soil and fibres and/or pellets, artificial or natural fibre materials such as but not limited to glass-, stone- or rockwool, coconut fibres or the like, cotton or other fibre material. In this description a substructure has to be understood as any artificial or natural surface on which modules according to the description can be placed and supported, either directly or indirectly, such as but not limited to ground, soil, sand, clay or such natural surfaces, or roofs of buildings, or concrete, tarmac, brick or such artificial surfaces.

In this description membrane has to be understood as including but not limited to any kind of woven or non woven sheet or foil, made of any plastic or natural material or mix of materials, including but not limited to plastic sheet or foil, natural fibers, geo-textiles, water permeable and/or water impermeable materials and the like. Preferably the membrane will be flexible, such that it can be placed from a roll or as relatively large sheets, compared to the sizes of the modules to be described. However, the membrane can also be provided in different ways, for example as tiles or as an in situ coating.

Figure 2:
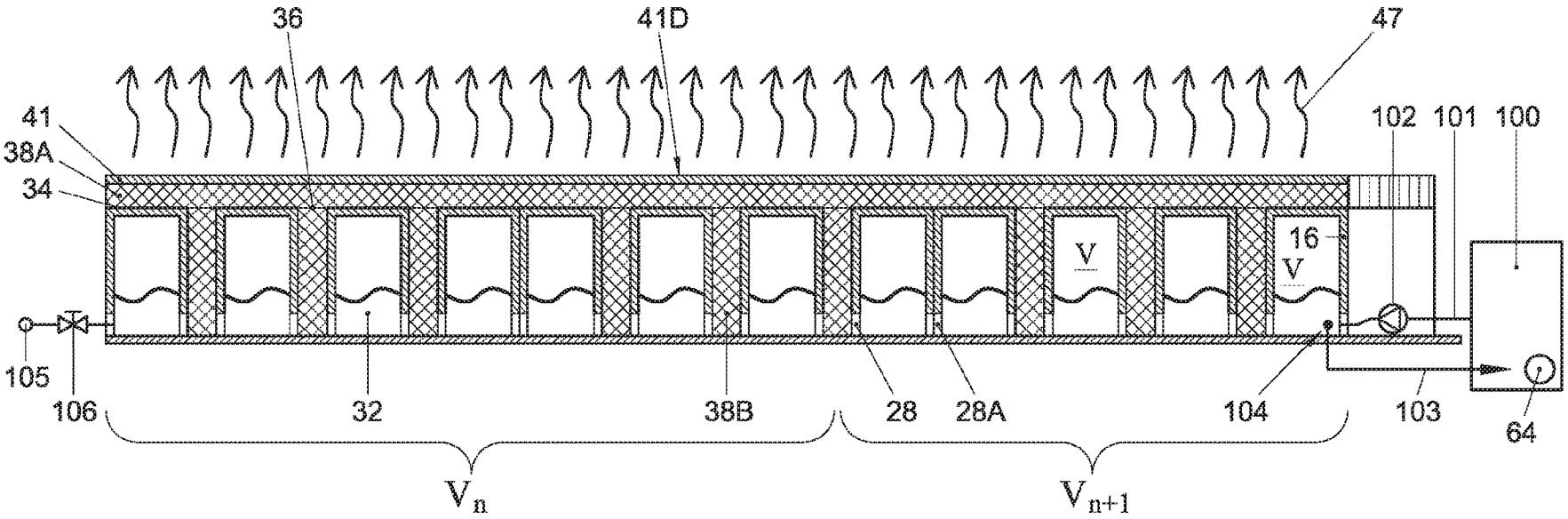
FIG. 2 shows in cross section schematically a series of sports fields structures, interconnected and forming a sports field area.

FIGS. 1 and 2 show schematically in a cross sectional side view a sports field structure 1 according to this disclosure, in a first embodiment, comprising a base element 10 comprising a deck 12 forming a top wall, and can be provided with side walls or a peripheral side wall 16 extending down from a peripheral edge 14 of the deck 12. The deck is carried by a series of pillars 18 extending from the deck 12 downward. The base element or module 10 can be positioned on a substructure 2, such as bed of sand or soil, on a floor such as a concrete floor, or on any suitable substructure, such that lower ends 20 of the pillars 18 and/or the lower ends 19 of the wall or walls 16 rest on the substructure 2 or a layer 3 provided thereon. Preferably both the wall 16 and at least a number of and more preferably all pillars 18 support the module 10 on the substructure, such that a more even distribution of forces between the deck 12 and the substructure 2 is obtained. A cover is carried on the deck 12, providing a surface 41A forming a sports field or part thereof.

Figure 1A:
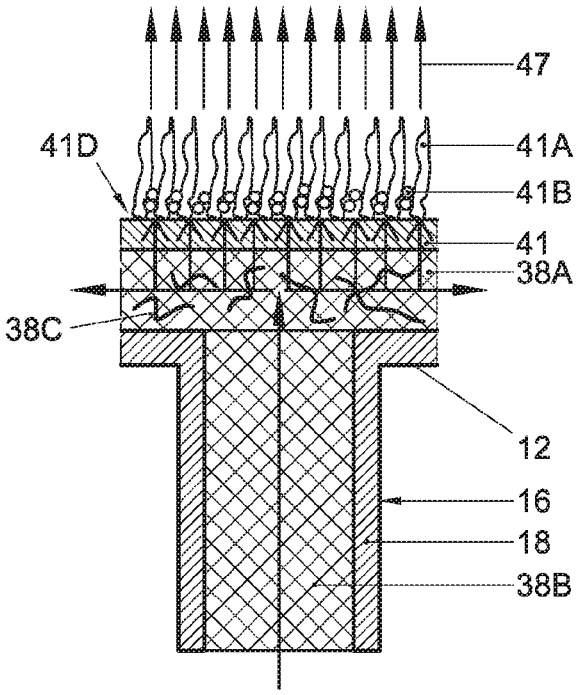

FIG. 1A shows at an enlarged scale part of a cross section.

In this embodiment the module 10 is largely open at a bottom side 22. On the substructure 2 a membrane or layer 3 can be provided, such as for example a sheet of fabric or plastic foil or any other suitable membrane. Such layer can for example be a geo-textile. In embodiments the layer can be a water impermeable layer, preventing water from flowing out of the modules into the substructure or vice versa. In embodiments the layer 3 can be used for preventing movement of the substructure, such as for example preventing erosion of the substructure 2. In embodiments the layer can be provided for covering the substructure 2 in order to prevent for example chemicals to enter into the modules 10 which can for example be beneficial when the modules are used for covering polluted areas such as but not limited to waste land, garbage areas or the like. Alternatively the layer 3 can prevent fluids from entering into the substructure undesired. Thus the structure can be used in environments wherein for example products are used that can be detrimental to the substructure or should be prevented from entering into a surface material or an eco system, such as entering into ground water.

As can be seen in FIGS. 1-8 at least some of the pillars 18, which can also be referred to as columns, have a substantially open top end 24 in the deck 12. In the embodiment shown it can be seen that the pillars 18 as such are hollow and form a substantially open channel 26 between the open top end 24 and the lower end 20. As will be described some or all of the pillars 18 can be filled partly or entirely with a wick material 38B or wick element 39 and/or can have a closed lower end.

In the embodiments shown the pillars 18 can have any suitable cross section perpendicular to their longitudinal axis Zp, for example but not limited to a circular, square, rectangular or polygonal cross section. The cross section can be substantially the same over the longitudinal length of the pillar, seen along the axis Zp, but the cross section can also vary. The pillar can for example be partly or entirely conical, for example such that it has a draft, suitable for injection moulding or a stronger draft. Suitable shapes and dimensions will be directly apparent to the skilled person. The modules 10 are preferably made integrally, including the pillars 18, deck 12 and walls 16, for example by injection moulding. Alternatively they can be assembled from different parts.

The pillars 18 can be provided with one or more openings 28 extending through the wall 30 of the pillar 18, connecting the channel 26 with an internal volume V of the module 10. In this embodiment the internal volume V is enclosed between the deck 12, the side wall or side walls 16 and the substructure 2, between the pillars 18. In the embodiment shown in FIGS. 1, 2 and 3 the openings 28 are provided near or at the lower ends 20, close to or directly adjacent the substructure 2. However openings 28 can be provided in any suitable position, for example at different longitudinal positions between the lower and top ends 20, 24. Similar openings 28A can be provided in the side wall or peripheral wall 16. Such additional openings 28A can also be provided at different positions along the wall or walls 16, for example at different heights.

In FIGS. 1 and 2 schematically a volume or body of water 32 is shown in the internal volume V of the module 10. The substructure 2 and/or the layer 3 can at least partly close off the open bottom side 22 of the module 10, such that the body of water 32 can be retained inside the internal volume V for an extended period of time. In such embodiments the internal volumes V of adjacent modules can be in communication with each other, for example through the openings 28A in the walls 16, such that these internal volumes V effectively form an integrated internal volume. This can be beneficial for obtaining a desired distribution of water through an array of such modules, as will be explained. By specific positioning the openings 28A can act as weirs, defining a water level in a module before water can flow over to an adjacent module 10 through such opening 28A.

As can be seen in for example FIGS. 1, 2, 3 and 8 a cover 13 is provided on a layer 34 which can be placed on top of the deck 12, covering the deck 12 at least partly and preferably entirely. Initially the layer 34 may be a closed sheet or foil covering the entire deck 12. The layer can for example be made of or with fabric, and can be resilient. The layer 34 can for example be an artificial layer made of a flexible plastic or rubber material. The layer 34 can for example be a layer as ordinarily used in known artificial sports fields directly below the cover layer. The layer 34 can be referred to and/or formed as or comprise a membrane.

Figure 7:
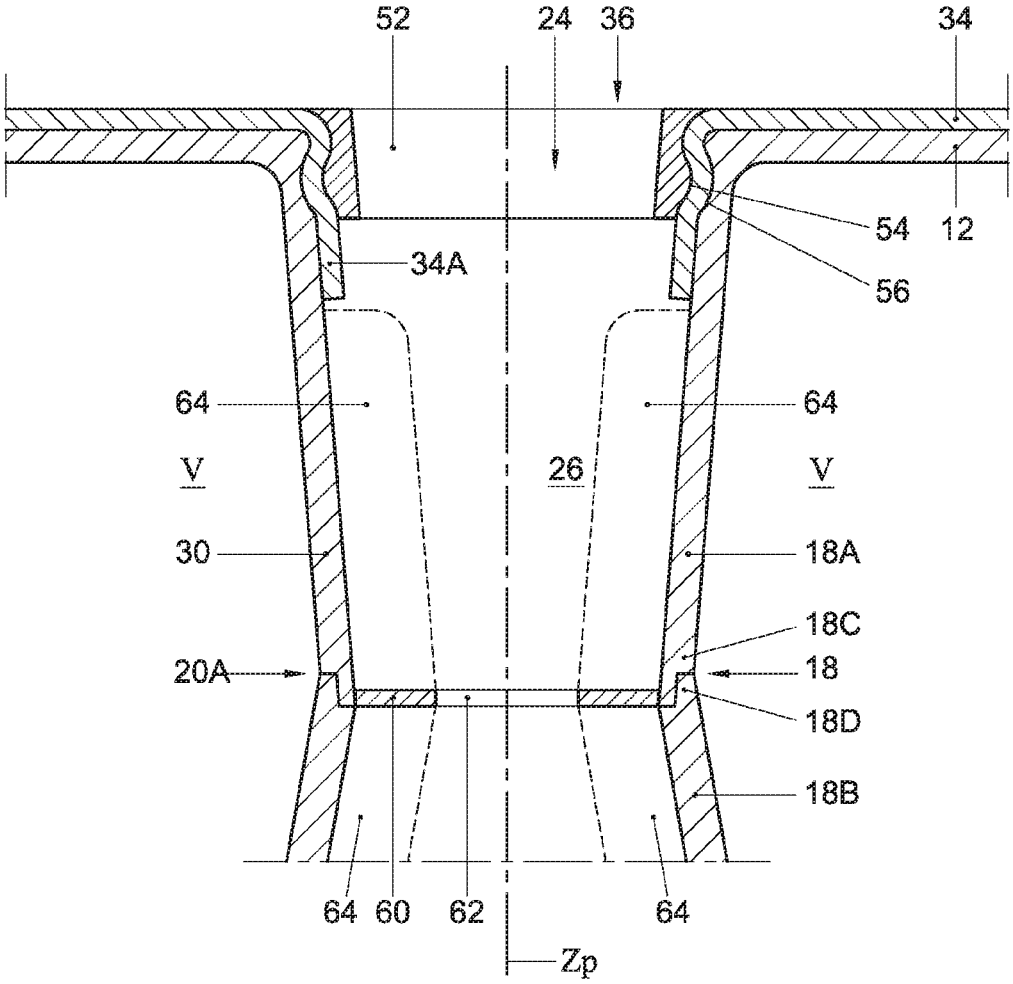
FIG. 7 shows schematically a detail of the membrane or top layer locked by a locking element.

As can be seen in FIG. 7 the pillar 18 which is shown empty for clarity sake, a slit or cut out 36 has been provided in the layer 34, directly over the open end 24 of said column 18. Similar slits or cut outs 36 have been provided for other pillars 18, forming an open connection between an upper side of the layer 34 and the channel 26 in the respective pillars 18. The slits or cut-outs 36 can be made in situ, that is when placing the layer 34 over the module or array of modules 10, for example by cutting, tearing, drilling or otherwise providing the opening in the layer 34 into the or each respective pillar 18. The advantage thereof can be that the cut-outs or slits can be provided at will in positions where they are desired. Alternatively the slits or cut-outs 36 can be provided pre-fabricated in the layer 34. The layer can for example be a perforated sheet or foil, with openings 36 arranged in a pattern, at least in part corresponding with the pattern of the open ends 24 of at least a number of the pillars 18 of the modules 10.

Figure 3:
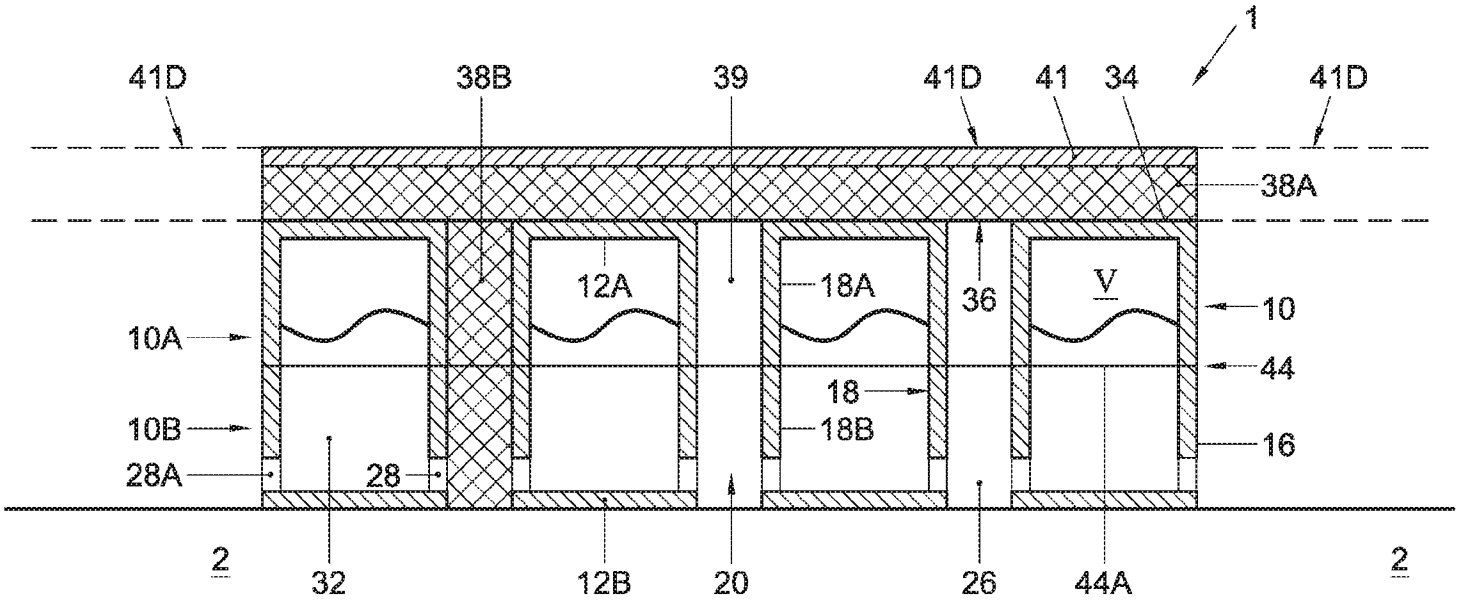
FIG. 3 shows in cross section schematically an alternative embodiment of a sports field structure, wherein the base element comprises or is formed as a substantially box shaped module with an internal volume for retaining water and/or allowing water and/or air flow.

As is shown in FIGS. 1, 2 and 3 on the layer 34 at least one top layer 38A is or can be provided, covering the layer 34 and thus the module 10. In the channels 26 of at least a number of the pillars 18 an amount of a wick medium 38B is provided, forming a wick element 39, which can be directly or indirectly in communication with the top layer 38A on the layer 34 through the open ends 24. In embodiments material of the layer 34 and/or the top layer can be the same as the wick medium 38B inside the channels 26. In other embodiments they can be different in for example material, consistency, compactness or other such aspects.

In embodiments the top layer 38 can be provided on top of the membrane 34 or directly on the deck 12, and can for example be an integral layer such as a mat or foil, can be provided as segments or can be loose material, or combinations thereof. In embodiments the top layer 38A can comprise or be formed by a layer 38A of a water regulating material, as is known in the art of artificial or natural turf sports fields. In embodiments the layer 38A of water regulating material can comprise a natural material such as for example sand or clay, mixed with fibres 38C, such as but not limited to natural or artificial fibres such as for example glasswool or rockwool fibers, cotton or such fabric fibres or the like. The fibres can have different effects in the layer 38A, either one of these effects or some or all in combination. The fibres 38C can aid in providing a consistency and stability of the layer 38A, especially when the layer 38B has been wetted substantially and/or when the layer 38A comprises or consists of relatively loose material. The fibres 38C can aid in water retention and/or distribution through the layer 38A for example by capillary action. The fibres 38C can aid in transportation of water through the layer, from the pillars 18 to and/or through the top layer and/or vice versa. The fibres 38C can aid in specific distribution and retention of water over the field. For example by providing more fibres 38C in a specific area than in an other area the area with a higher fibre concentration may receive more water from the structure and/or prevent more water flowing back into the structure, which may lead to a higher evaporation in such area than in other areas with a lower fibre concentration.

As can be seen in the drawings, the wick medium 38B and/or element 39 present, in the pillars 18 can be in contact with the volume of water 32 inside the modules 10 through the opening or openings 28, as well as with the top layer 38A on top of the layer 34 or deck 12. Thus water will be transported from the volume of water 32 to the medium 38A on top of the layer 34 through the wick medium 38B or element 39 inside the channels 26. This will preferably be a natural transport such that any water removed from the top layer 38A, for example by evaporation, drainage or otherwise, will be replenished from the volume of water 32 in a suitable pace. This pace can for example be influenced by the number of and distribution of the pillars 18 filled with the wick medium or element 39 or more in general the number and distribution of wick elements, the amount and type of wick medium inside the pillars, the longitudinal depth to which extend the channels is or are filled and the size and distribution of the openings 28 and the hygroscopic properties of the materials, especially of the top layer 38A and possibly the layer 34, if any.

In a sports field or structure according to the invention at least part of the structure and/or top layer and/or membrane can be covered by a cover layer 41 forming a surface 411D for preforming sports on, as described. In embodiments the top layer 38A can be formed by or comprise an artificial cover layer 41, which can, as discussed, form the surface for performing sports on. In embodiments the top layer 38A can be covered by a cover layer 41 forming the surface for performing sports on. In embodiments the top layer 38A can be omitted in part or entirely, the cover layer 41 being placed directly on top of the deck 12 or layer 34. The cover layer 41 can comprise filaments 41A and filler material 41B, for example sand or rubber or plastic elements, as shown e.g. in FIG. 1A, which can form part of the surface 41D In FIG. 2 by way of example a system is shown for regulating the water level inside the internal volume V. At the right hand side a storage tank 100 is shown, connected to the volume V by a first line 101, comprising a pump 102, and a second line 103, having an inlet 104 in connection with the volume V. The inlet 103 preferably comprises or is formed by a settable end, such that the inlet can form an overflow at a desired level of water inside the volume V, thus acting basically as a weir. Any water entering into the volume V, for example due to rain, will raise the water level inside the volume V. If said level rises above a set, desired level, water will flow through the inlet 103 and second line 102 into the tank 100. If the level of water sinks below the desired level water can be supplied from the tank 100 through the first line 101 and the pump 102. A suitable water level sensing unit can be provided in a known manner, for example a float, syphon or the like. Such systems are well known in the art. At the left hand side a water mains 105 is shown, connected to the volume V. Should at any time the water level inside the volume V get below a desired level, water can be supplied through the water mains, regulated by a valve 106. For example when there is an insufficient amount of water in the tank 100.

By regulating the water level in the volume V, the hydration of the layers 34, 38A and/or 41 can be regulated and thus for example evaporation and thus cooling and/or heating of the field can be regulated.

As is shown schematically in FIG. 1A by arrows W, water can be transported up from the volume V through the material 38B or element 39, preferably at least by capillary action and into the cover 13, especially the top layer 38A, to be distributed through the cover 13. Then the water will flow up further, to the surface 411D and evaporate due to e.g. the heat of the surface 41D and/or air above it, wind or the like. Obviously water can also be transported in the opposite direction. If fibres 38C are provided in the cover 13, they may aid in transport and distribution of water.

Figure 8:
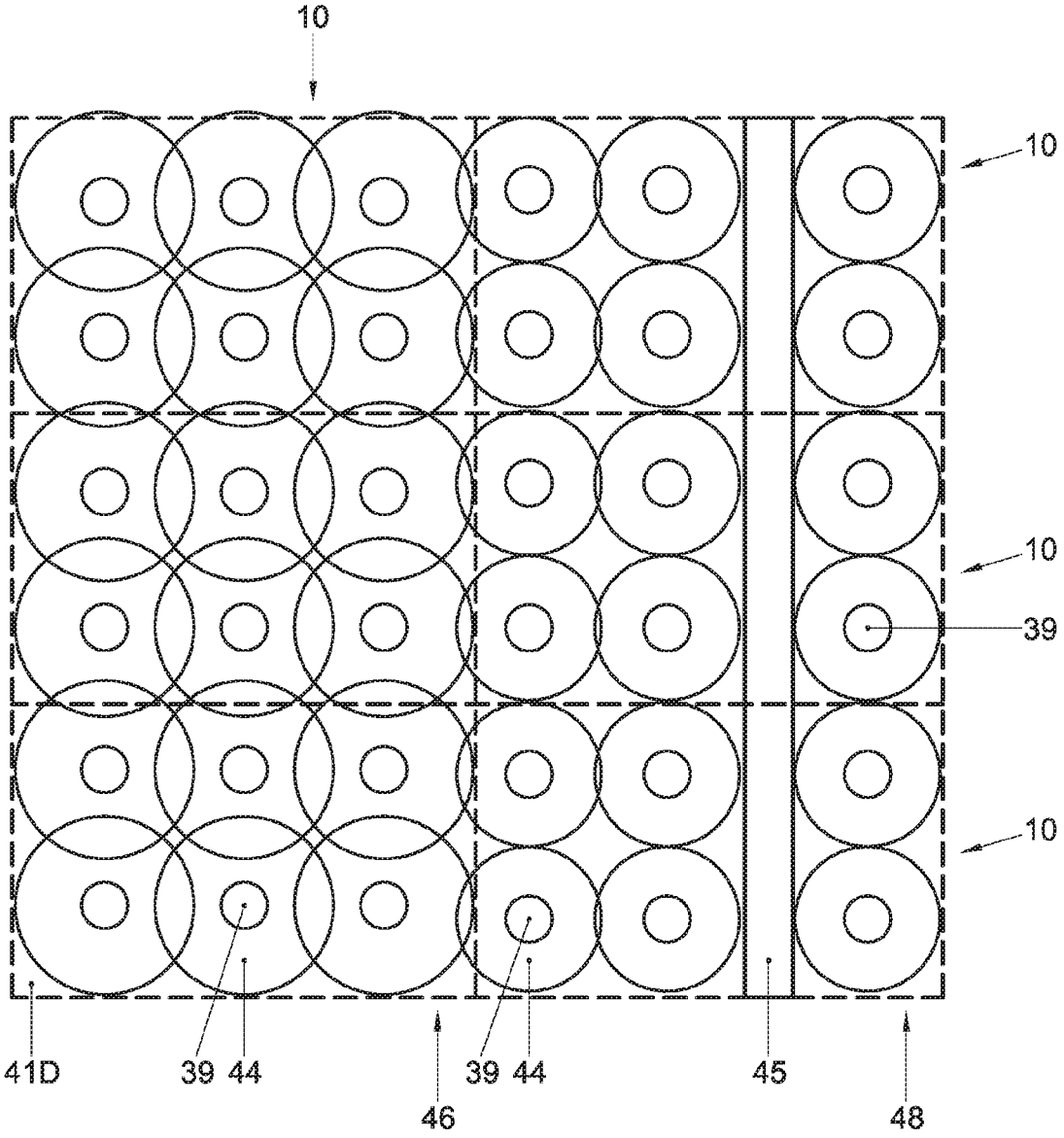
FIG. 8 shows in top view part of a sports field.

As can be seen in FIG. 8 during use water transported from the voids in the modules will be transported by the wick elements 39 and/or wick medium 38B to the top layer 38A and will be distributed in and/or over said top layer and/or cover layer 41 over an area 40 surrounding an upper end of said wick element cq a pillar or channel n which such wick element is provided or formed by wick medium. For example by evaporation and/or by backflow into the voids the water will then retract heat from the cover layer 41. Alternatively water may be supplied in this manner in order to warm the top layer 38A and/or cover layer 41, for example during cold periods. To this end the water could be heated, either inside the voids in the modules, or externally to the modules, for example in the tank 100. Moreover, since the water level inside the volume V can be regulated, an air space can be provided and/or maintained above the water, which air may be used for further cooling and/or heating of the top layer, and/or for ventilation thereof.

Figure 4:
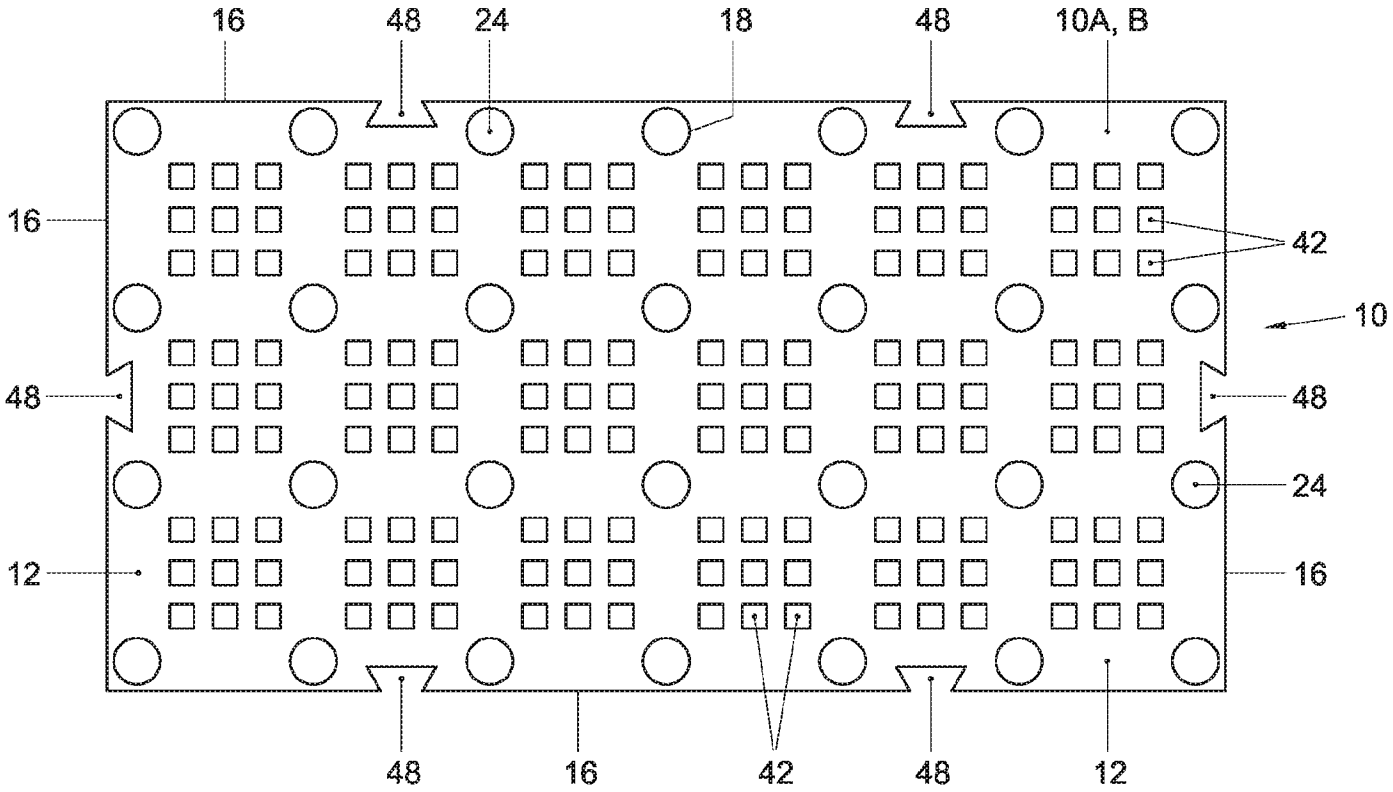
FIG. 4 shows schematically in top view a base element, in a embodiment.
Figure 5:
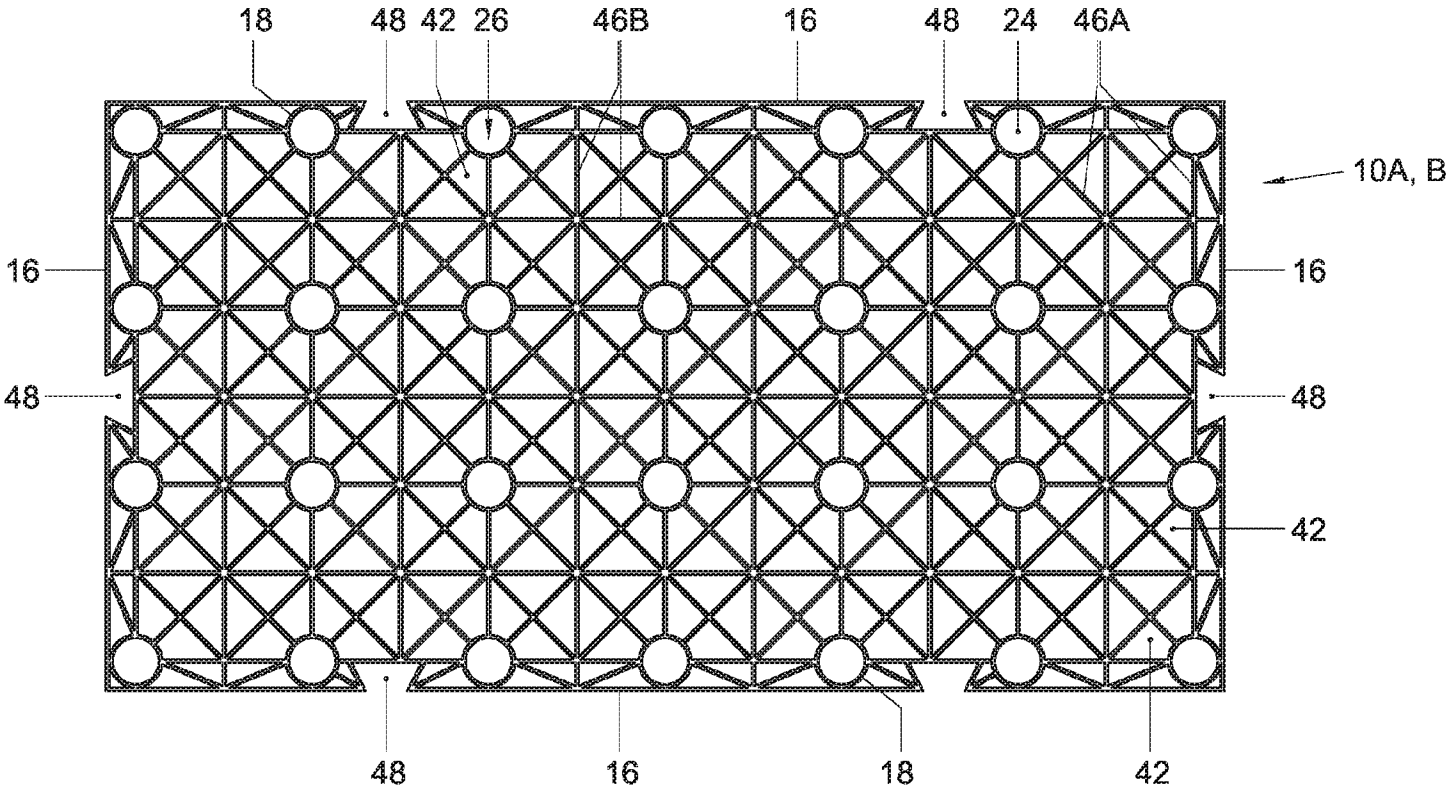
FIG. 5 shows schematically in top view a base element, in a second embodiment.
Figure 6:
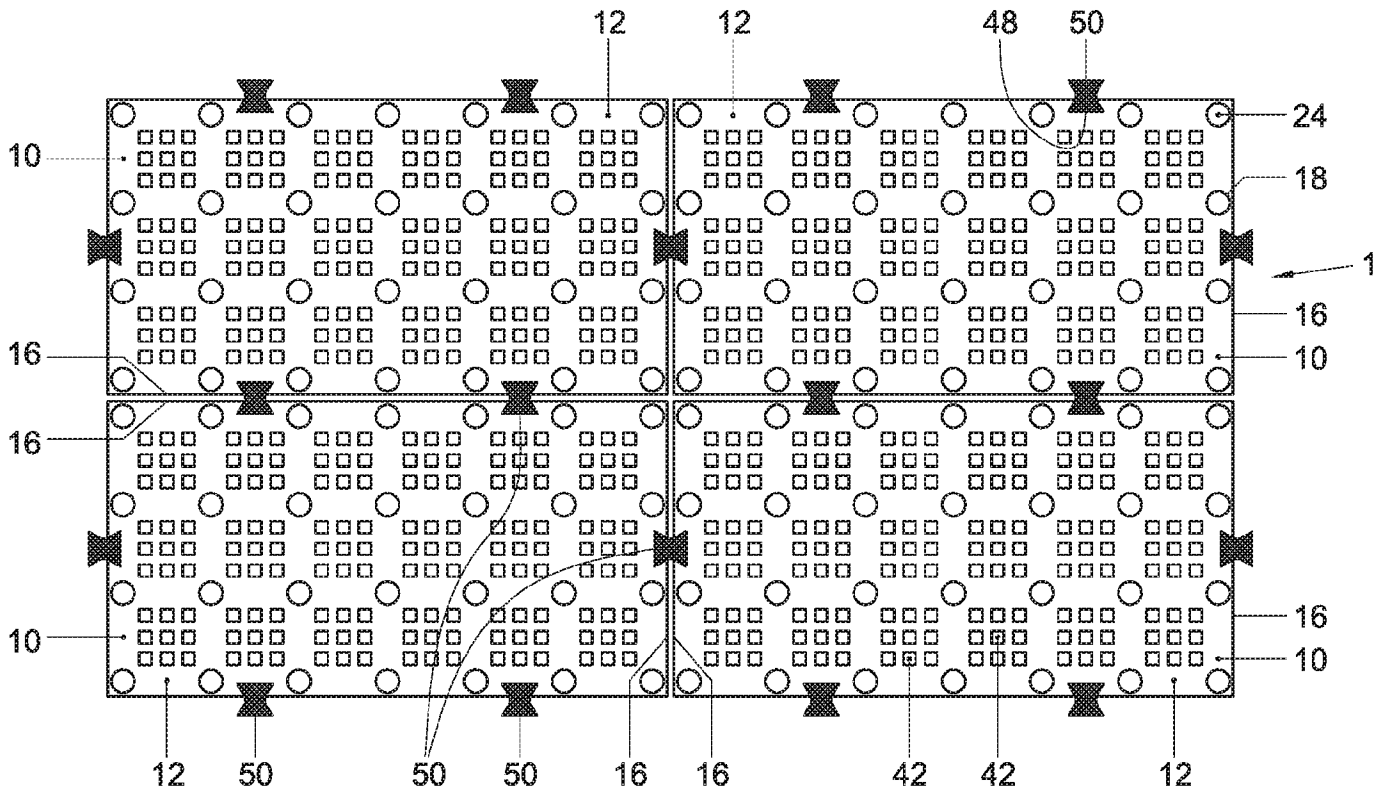
FIG. 6 shows schematically in top view a series of modules interconnected.

The deck 12 can be provided with additional openings 42 extending into the internal volume V. These openings 42 can be covered by the layer 34, such that the top layer 38A cannot pass into and through the openings 42. In FIGS. 4-6 embodiments of the modules 10 are shown in top view, showing open ends 24 of pillars 18 and openings 42. The layer 34 can be water permeable, such that water can pass from the top layer 38A through the layer 34 and the openings 42 into the internal volume V of the modules 10, to be retained therein or to flow away. This can for example prevent the top layer from becoming saturated or even over saturated with water. Moreover this allows the volume V to be filled with water from above, for example by rain or irrigation. Additionally or alternatively water from the internal volume evaporate through the openings 42 and be absorbed by the fabric anchor the growing medium 38. Alternatively the structure can be used as a tidal system, by filling the modules by providing a flow of water through the modules, such that the water level rises, for example to a level close to or in the openings 42, and then draining the water again. The layer 34 can be water impermeable, closing off the openings 42, which can for example be advantageous when evaporation of water from the internal volume V should be prevented, for example when the modules 10 are used in relatively hot environments, such as but not limited to tropical or semi-tropical environments. The layer 34 can be air permeable, such that air can enter into the top layer 38A from below, for example through the openings 42, in order to aerate the top layer 38A and/or to cool and/or heat the top layer by cool or warm air blown through the modules. A natural or forced air flow could be provided through the modules 10 to promote such aeration or temperature regulation.

In FIG. 2 a series of modules 10 is shown, interconnected in a suitable way, for forming a larger area of a sports field 1. The decks of the modules 10 preferably form a flat and/or continuous surface area, and are covered by the layer 34 extending over the series of modules. The modules can be arranged in a matrix of rows and columns, as is for example shown in top view in FIG. 6 showing four modules 10, for covering any size and/or shape area. As discussed the internal volume V can be a continuous volume throughout the area or part thereof. Alternatively modules 10 could be provided with closed peripheral walls, that is free of openings 28A or such openings blocked, such that some or all of the modules have their own closed internal volume V. In general the wick element and/or medium 38B in the channel or channels 26 will lead to wetting of the top layer 38A in a substantially circular area around the relevant opening 24. By strategic filling of some channels 26 and leaving others empty or partly empty a specific desired wetting pattern of the top layer can be obtained, as for example shown in FIG. 8.

In embodiments the structure formed by the modules 10 can be divided up in different compartments, each compartment comprising one or more coupled modules 10 having a combined internal volume $V_n$, separated from the internal volume $V_{n+1}$ of the or each other compartment. Each compartment can be provided with a series of wick elements or columns filled with wick material, wherein the number or distribution of such elements or filled columns can vary between compartments, and/or wherein the wick material and/or capillary capacity can vary between the different compartments. Additionally or alternatively the different compartments can be arranged to have the water level and/or water temperature in each compartment set independent from the water level and/or temperature in adjacent compartments. In such embodiments different areas of the sports field 1 can be treated differently, for example by having the layers 34, 38A and/or 41 wetter, dryer, warmer or cooler than adjacent areas, providing for more evaporation in areas than in other areas, or providing similar differences. In such embodiments communications between different compartments may be impossible or may be possible for exchange of water and/or air. In case such communications are possible between compartments such communication may be regulated by for example valves, preferably such that an operator can actively set such communication.

In FIG. 3 schematically an alternative embodiment is shown, wherein the module or base element 10 is box shaped. In general this can be understood as that the module 10 is comparable to that as shown in FIG. 1, but is provided at the bottom side 22 with a bottom 12B. This could be a bottom element attached to the bottom 22 of the module 10 as disclosed and discussed with reference to FIGS. 1 and 2. In the embodiment shown in FIG. 2 the module 10 formed by connecting two module parts 10A, 10B over a connecting area 44 indicated in FIG. 3 by the line 44A. This connection can be made in any suitable way, either permanently or reversibly. The connection can for example be made by welding, gluing, clicking, screwing or any other suitable way known to the person skilled in the art. In the embodiment of FIG. 3 each part 10A, B comprises a part of a side or peripheral wall 16 and part of the pillars 18. The lower part 10B comprises a bottom 12B, similar to the deck 12, such that the module can be placed on a substructure supported at least largely by the bottom 12B.

In embodiments internally the module 10 can contain pillars 18 extending vertically between the deck and bottom 12, 12B which can aid in resisting vertical deformation or crushing of the module 10. In embodiments the module 10 can be assembled from two substantially identical integral components 10A, 10B moulded from a rigid plastics material and which are fitted one inverted on top of the other. Each pillar 18 thus comprises two half-pillars or male and female parts 18A, 18B respectively, one part being integral with one component 10A or 10B and the other part being integral with the other component 10A or 10B. In embodiments male parts 18A can alternate with female parts 18B in each component 10A and 10B such that when the two components are fitted together the male parts 18A of each component enter the respective female parts 1813 of the other component to form the complete pillars 18. To avoid over insertion of the male parts into the female parts, and to maintain the top and bottom walls 12 and 14 at their correct separation, each male part can for example comprise a shoulder 18C which abuts against the open end 18D of the respective female part when the components 10A and 10B are fully engaged, as is for example schematically shown in FIG. 7.

As shown in FIG. 4 the deck 12 and, if applicable, the bottom 12A of a module 10 can be formed by a sustainably closed plane comprising the openings 42 and open ends 24 of the pillars 18. In this embodiment the openings 42 have a substantially square cross section, but they can have any cross section desired, such as but not limited to round, oblong, polygonal or the like.

In FIG. 5 an alternative embodiment is shown, wherein the deck 12 and, if applicable, the bottom 12A can be formed substantially open. The deck 12 and/or bottom 12A can be formed substantially by a structure of intersecting ribs 46A, B extending between at least open ends 24 of pillars 18 and between open ends 24 of pillars and side walls 16 of the base element 10, and/or between other ribs.

In embodiments the bottom 12B can be according to FIG. 4 and the deck 12 could be according to FIG. 5 or vice versa.

As can be seen in FIGS. 4, 5 and 6 the module 10 can be provided with side wall channels 48, extending over part or all of the height of the module 10 or a module part 10A, B, which can have a cross section non-releasing in the direction of the relevant side 16 of the module. In the embodiment shown the side wall channels 48 have a substantially dove tail shape cross section. When two modules are appropriately placed next to each other, side walls 16 facing and abutting, at least two such side wall channels 48 will be adjacent to each other and open to each other, forming a substantially bow-tie or butterfly shaped joined channel. A locking element 50 having a shape complementary to the joined channels 48 can be press fit into said joined channels 48, locking the modules to each other. As can be seen several such channels 48 can be provided on all sides of the modules 10, assuring a very firm connection between all modules. Obviously other such locking elements 50 and complementary channels 48 could be provided or other means for coupling the modules.

The modules 10 can contain a network of bracing members to resist geometric deformation of the module in a horizontal plane and/or in vertical direction. The bracing members can for example be formed by the ribs 46A, B as shown in FIG. 5 and/or extend in a pattern as shown in FIG. 5, and can be internal within the internal volume of the module, for example below a deck 12 as shown in FIG. 4. The ribs 46A can for example extend parallel to a side wall or diagonally between pillars 18 and can comprise or form vertical webs having apertures to allow fluid flow horizontally through the module 10 in any direction. The webs can be orientated vertically such that they do not obstruct fluid flow in the vertical direction. Each rib and/or web can be formed of upper and lower halves integral with upper and lower components 10A, 10B respectively, and can have facing non-straight or at least not completely connecting edges, such as for example concave or wavy edges defining apertures between them. In embodiments the edges can be parabolic. Between the ribs 46A and/or webs further ribs 46B can be provided, which can also form or comprise webs extending into the inner volume V and can serve to break down voids within the volume V. As viewed from above in FIG. 5, they can extend substantially normally between the bracing ribs 46A and supplement the bracing effect of the latter. By way of example and not limiting the disclosure, in embodiments the ribs 46A, B can for example be a few millimeters thick, for example about 5 mm thick and can extend downward or upward from the deck 12 or bottom 12B in a direction normal to the page a few millimeters to several centimeters and can bridge about all of the internal height of the module.

In FIG. 7 schematically in enlarged scale part of a module 10 with a deck 12 covered by layer 34 is shown, with part of a cross section of a pillar 18 showing the wall 30 and a joining between two pillar halves 18A, B with shoulders 18C, D. In this embodiment the layer 34 is connected to the module 10 by press fitting a locking element 52 into the open end 24 of a pillar 18, through a cut out or slit 36 in said fabric 34, such that part of the layer 34, especially an edge portion 34A of the cut-out opening or slit 36 is forced into the channel 26 of the pillar 18 and is locked between the locking element 52 and the wall 30 of the pillar 18 and/or an edge portion of the deck 12 at the opening 24. In the embodiment shown the locking element is shown, by way of example only, as a ring shaped element 52, comprising a slightly conical shape, with a peripheral snap ring 54 extending outward, which can snap into a peripheral groove 56 provided in the wall 30 of the 8 just below the deck 12. Thus by pressing the ring with the smaller end of the ring 52 forward into the opening 24, the layer edge 34A is forced over the groove 56 where after the snap ring 54 is pressed into said groove, forcing the layer into the groove 56 too. This will lock the ring 52 by form lock into the opening 24. It shall be clear that all kinds of alternative locking provisions can be provided for locking the layer and/or a locking element in said opening 24, such as but not limited to press fitting under friction, snap fitting the ring under an undercut edge of the deck, matching, preferably coarse screw threads or bayonet elements on ring 52 and the opening 24, or by for example adhesion. In embodiments the locking elements 52 can be designed to form the opening referred to as a slit or cut-out 36 in the layer 34 in situ, during insertion thereof into the opening 24. By using such locking elements the layer 34 can be provided secure and preferably relatively taut over the deck 12 without the need to provide additional openings in the layer 34 or for example adhesives. The locking member 52 can be provided either fixed or releasably. Alternatively the deck 12 can for example be provided with one or more slits into which an edge of the layer 34 can be inserted and clamped. Such slit can for example be substantially triangular, such that the edge can be pulled tight into the tight end of the slit.

In embodiments the membrane or layer 34 can be locked in place by wick elements 39 inserted into the columns 18

In embodiments the locking element can comprise supporting elements such as for example a cross of beams or the like. In use extending over the opening of the channel 28, supporting the top layer and preventing it from bending into said opening. Thus the flatness of the top layer can even better be ensured.

As discussed before, the layer 34 could also be omitted, placing the top layer 38A for example directly on the modules, or the layer 34 can be part of the top layer. Also instead of the layer 34 the top layer 38A could be connected to the modules, for example in the disclosed locking manner or a similar manner. In embodiments the cover layer 41 can be placed directly on the deck, leaving out or integrating the top layer 38A and/or the membrane 34.

The channel 26 can be provided with one or more restrictions, such as but not limited to flanges or ridges extending into the channel 26 from the wall 30, such that the wick medium is prevented from or at least restricted in falling further down the channel towards the end 20 thereof. In FIG. 7 such restriction is shown as a flange 60 extending from near the end 20A or shoulder 18C of the pillar half 18A, inward into the channel, leaving only an opening 62 in the channel with a cross section smaller than the cross section of the directly adjacent part of the channel 26. Such restrictions can be provided in different or several positions, and could for example be formed by ribs 64 extending substantially parallel to the longitudinal axis too, as schematically shown by dashed lines in FIG. 7, in a direction of release of the pillar in a manufacturing mould. The restrictions can limit the depth into which the wick medium can be inserted and prevent it from being pushed further due to for example gravity, vibrations or impact pulses.

In general modules can be used as disclosed as structural modules in for example WO0214608, WO2011/007128 or WO2011/007127, all of which are considered to have been incorporated herein in their entirety as published, as far as the detailed description and the drawings are concerned.

In FIG. 8 a series of modules 10 forming a surface structure is shown, from above, schematically showing a pattern of wetted circles 44 of the top layer 38A surrounding openings or wick elements 39. In FIG. 8, by way of example, schematically a side line 45 is shown, separating a playing area 46 of the field from a side area 48. By way of example the wetted circles 44 well in the playing area 46 are slightly larger than near and in the side area 47, for example by providing less wick material in the side area 48. Preferably the wick elements 39 or wick material 38B is provided in a regular pattern, depending on the desired wetting and evaporation, cooling and/or draining of a sports field area.

In embodiments the deck of the modules can be substantially closed, except for the open ends 24 of the pillars or at least some of the pillars. Substantially closed should be understood as including having openings so small that the top layer can be supported on top of the deck substantially without bulging into these small openings. In embodiments this can be achieved by closing off openings in the deck by for example plugs, lids or such elements and/or a membrane 34.

According to the disclosure a sports field surface structure or area can be formed by placing a series of modules 10 on a substructure. Preferably the modules 10 are coupled in rows and/or columns. Said modules 10 comprise a deck 8 and columns 18 opening into said deck 8. A series of said columns 18 is filled at least partly with a wick medium 38 or wick elements 39. On top of the modules 10 a top layer 38A is provided, in fluid connection with the wick medium 38B or element 39 in the or each column 18 filled at least partly with said wick medium 38B or element 39. Water is provided or retained in said modules 10 for hydration of the top layer 38A on top of the modules through the wick medium 3813 or element 39 in said columns 18 and/or for draining water from the top layer 38A on top of said modules 10. To this end for example water can be flushed into and/or from said coupled modules, for example from a side of a series of modules. In embodiments water can be provided from the top, for example by rain and/or sprinklers or such artificial raining devices and/or by a tidal system, wherein part of the water can be retained inside the modules for later use. In embodiments water can be provided from a tank 100 and/or a mains 105. Water contained in the layer 34 top layer 38*a* and/of cover layer 41 can then evaporate from the cover layer 41, as symbolically shown in FIGS. 1A and 2 by arrows 47, thereby cooling the surface of the cover layer 41. By providing more or less water in the layers 34, 38A and/or 41 the evaporation can be regulated, such that the temperature of the surface of the cover layer can be regulated at all times, to a high degree relatively independent from for example air temperature above the surface, radiation by the sun, shadow and the like factors external to the field structure. For example for a field in a stadium a part of the field directly in the sun can be cooled more intensive than a part of the field in the shadow of the stadium, which may change during a day. Thus for example in the morning a first part of the field may be cooled more intensively by providing more water to evaporate than another part of the field, whereas later in the day the same first part of the field may experience the shadow of the stadium and will then be cooled less, whereas the other part may have to be cooled more intensive because of it becoming exposed to direct sun light. Thus the temperature of the surface of the cover layer 41 and thus of the field can be kept within limits and temperature differences over the filed can also be kept minimal.

Sports field structures according to the disclosure can have the advantage that loads and forces provided on top thereof are distributed over relatively large areas, allowing higher loads and forces without becoming unlevel or uneven. An area of the disclosure can provide for suitable and substantially constant supply of water without the risk of over saturation and without the necessity of mechanical means for irrigation. A sports field area according to the disclosure can have the advantage that a substructure can be protected, and that an area can be provided on substantially all kinds of sub structures, permanently or temporarily. A sports area according to the disclosure can have the advantage that the base element or module can provide for flexibility and/or damping for for example people or animals trafficking the area, such as on sports fields, crowded areas such as at festivals or other such places. Sports fields according to the disclosure can have the advantage that they can be used on straight and sloping surfaces, can be formed quickly using any suitable substrate as a wick medium and allows for optimisation of cooling and/or heating. Sports field structures according to the description can have the advantage that locally wetting can be optimised, for example by adaptation of the distribution of channels filled with wick medium and/or adaptation of the wick medium in said channels.

In a sports field or sports field area according to the present disclosure a water balance can be provided between one or more storage tanks 100, the capillary system of wick elements or material 38E in the pillars and the top layer 34, 38A and the sports surface, and/or an air layer within the volume V. A surplus of water, for example due to rain can be transported into the volume V through the layer 38A and wick material or elements 38E, and if necessary into a tank 100, whereas when the layer 38A is drying, for example due to evaporation of water, water can again be replenished.

In sports fields having an artificial cover layer 41, it may be desirable to substantially saturate the top layer 38A and/or layer 34 and/or the cover layer, if evaporation of water from the cover layer 41 is desired. In general providing more water close to and preferably directly below or at the surface of the cover layer 41 will allow more water to evaporate and thus cool more. During cold periods the distribution and especially circulation of relatively warm water and/or relatively warm air, compared to the air temperature above the field and/or the field temperature, through the structure formed by the modules 10 and/or the layers may keep the temperature of the field elevated above a freezing temperature, such that freezing of the field and/or setting of snow or ice can be prevented and the field can for example be kept in a condition for it to be played on. In order to be able to circulate the air through the modules an air vent or similar air moving devices can be provided.

In the present invention a water supply 60 can be provided, for example connecting a water storage 100 and/or a water mains 105 to the one, some or all of the voids in the base structure. A pump 102 or such forcing means can be provided in a feed and/or return line 101, 103 such that water can be forced into and/or forced out of said void or voids. Thus the water level in and/or flow of water into and/or through the void or voids can be controlled. Moreover a cooling and/or heating device 64 could be provided for cooling and/or heating water used in said sports field structure.

In the embodiments disclosed the wick medium and/or wick element is discussed and disclosed as provided in a column. Alternatively or additionally a wick element and/or wick medium could be provided in a different manner. For example a wick element could be provided as a flexible wick such as a piece of fabric, extending through an opening in the deck and hanging into the void.

The present invention is by no means limited to the embodiments specifically disclosed in the drawings and description. Many variations are possible within the scope as defined by the claims. For example all combinations of parts of the embodiments shown in the drawings are considered to have been disclosed too. Base elements or modules as disclosed can be made by any methods and from different materials. Modules can be coupled in different manners and different ways or can be placed next to each other without coupling. They can be positioned in different orientations relative to each other, for example in a "half-stone", staggered relationship for even more rigid connections. Modules can be stacked for obtaining a larger internal volume V in the structure. The modules can have different shapes and dimensions, for example polygonal. Preferably they can be coupled such that they can form a substantially continuous surface area. These and many such variations are considered falling within the scope of the claims.

The invention claimed is:

1. A method for forming a sports field, wherein a series of modules is placed on a substructure coupled in at least one of rows and columns, said modules comprising a deck and columns opening into said deck, wherein a series of said columns is filled at least partly with a wick medium, and wherein on top of the modules a cover is provided, in fluid connection with the wick medium in each column filled at least partly with said wick medium, and wherein water is provided or retained in said modules for wetting at least part of the cover on top of the modules through the wick medium in said columns, wherein a membrane is positioned on or over the decks of the modules, the cover being provided on top of or comprising the membrane, wherein openings are provided in the membrane, opening into the columns filled with wick medium, wherein the membrane is attached to the module at at least one of in or at the opening or openings at the column or columns.

2. A method for forming a sports field, wherein a series of modules is placed on a substructure, said modules comprising a deck and columns opening into said deck, wherein at least some of said columns is filled at least partly with a wick medium, and wherein on top of the modules a cover is provided in fluid connection with the wick medium in each column filled at least partly with said wick medium, and wherein water is provided or retained in said modules for wetting at least part of the cover on top of the modules through the wick medium in each said column filled at least partly with said wick medium, and wherein at least some of the at least some of said columns filled at least partly with a wick medium are provided with one or more wall openings extending through a wall of the column for connecting the wick element inside said column with the water provided in or retained in said modules.

3. The method of claim 2, wherein a membrane is positioned on or over the decks of the modules, the cover being provided on top of or comprising the membrane, wherein membrane openings are provided in the membrane opening into the column opening into said deck at least some of the at least some of the columns filled with wick medium.

4. The method of claim 3, wherein the membrane is attached to the module at at least one of in or at the column opening into said deck at the least some of the at least some of the columns filled with wick medium.

5. The method of claim 2, wherein the at least one of the wall openings in said columns are provided between a top end and a lower end of the at least one of the columns.

6. The method of claim 2, wherein a water supply is connected to the modules.

7. A method of claim 2, wherein a water level inside the modules is controlled by forcing water into or out of the modules.

* * * * *